United States Patent [19]

Frisoli

[11] 4,023,296

[45] May 17, 1977

[54] HAMMER ACTUATORS FOR FIREARMS

[76] Inventor: David M. Frisoli, 2 Homestead Road, Edison, N.J. 08817

[22] Filed: Feb. 4, 1976

[21] Appl. No.: 655,000

[52] U.S. Cl. ..... 42/69 B
[51] Int. Cl.[2] ..... F41C 19/00
[58] Field of Search ..... 42/69 B; 89/125

[56] References Cited

FOREIGN PATENTS OR APPLICATIONS 427,973 8/1911 France ..... 42/69 B

*Primary Examiner*—Stephen C. Bentley

*Attorney, Agent, or Firm*—Arthur L. Plevy

[57] ABSTRACT

A hammer of a typical firearm is cocked at a point about a threshold of equilibrium so that the hammer may or may not move forward when the trigger mechanism is activated; means associated with the trigger mechanism imparts an additional force to the hammer to assure that the hammer will move toward the firing pin upon activation of the trigger.

The invention has utility in all firearms employing a hammer and trigger mechanism, but has particularly utility in regard to automatic or semi-automatic weapons.

6 Claims, 3 Drawing Figures

HAMMER ACTUATORS FOR FIREARMS

BACKGROUND OF THE INVENTION

This invention relates to firearm triggering mechanisms and more particularly to a trigger mechanism for a firearm capable of being activated with substantially reduced trigger force.

A major factor in determining the accuracy of a trigger actuated firearm resides in the user's ability to "squeeze" or release the trigger. A practical trigger in most weapons requires a substantial pressure to fire the weapon. A typical manually operated bolt weapon requires a user to impart about 2 to 3 pounds of force to activate the trigger, while an automatic weapon may require 3 to 5 pounds of force.

It can be easily ascertained that the user in imparting these forces via his trigger finger, will move or vibrate the weapon in doing so and this, of course, will adversely affect the accuracy of his shot.

Due to these and other considerations, there exists in the prior art, a mechanism typically referred to as a "hair trigger". Such a mechanism does not require a large trigger force to fire the weapon. These mechanisms are typically implemented by providing a very shallow recess on the hammer; which recess engages with a mechanism coupled to the trigger. Hence, a slight movement of the trigger removes the mechanism from the notch, allowing the hammer to go forward to strike the firing pin.

In a proper weapon, the hammer is usually cocked at a full position on the positive side of a null, so that when the hammer is released by the trigger, it will move rapidly toward the firing pin. In automatic weapons, the "hair trigger" of the prior art cannot be used. This is so as the shallow hammer notch and polished sear for restraining the hammer to enable hair trigger operation, are much too critical and the weapon may fire during automatic operation without using the trigger. For example, an automatic weapon employing a hair trigger mechanism may be fired during bolt return or chambering of a fresh cartridge.

Thus, the hammer may inadvertently operate due to the force of the bolt and thus ignite a cartridge without trigger pull. This action will cause an automatic or semi-automatic weapon to continuously fire all rounds without trigger pull and it is extremely undesirable, unsafe and unreliable.

Furthermore, the hammer can also be released before the bolt is fully closed to cause a misfire in a "hair trigger" weapon. These inadvertent operations can impose safety hazards on a user and are extremely dangerous and undesirable.

To prevent such problems, many prior art guns employ a hammer which is normally cocked almost at a null position, but slightly on the positive side. These weapons employ a polished sear which engages with a relatively deep hammer notch. The hammer in such weapons is prevented from reaching the null point or going behind or on the negative side of the null, by a mechanical stop which is positioned beneath the hammer on the receiver and located to allow the hammer to engage the sear when cocked. Hence, when the trigger is activated, the sear moves to free itself from the hammer notch, and the hammer once unrestrained, will move forward due to the cocking of the same at the positive side of the null.

Essentially, the hammer in such weapons is cocked so that it is on the positive side of the null and exerts a great force on the sear, which restrains the hammer from moving at this position. In such weapons, the sear is highly polished and fabricated from a hard metal to prevent wear due to the excessive force imposed thereon by the hammer. Such sears wear out relatively fast, break and are subject to great forces and pressures in such weapons.

It is an object of this invention to provide an improved trigger mechanism for a firearm associated with reduced trigger pull and hence, capable of improved accuracy.

BRIEF DESCRIPTION OF PREFERRED EMBODIMENT

In a weapon of the type employing a hammer for striking a projectile to be fired when struck, the improvement therewith of apparatus for providing a hammer release, comprising means coupled to said hammer for positioning the same prior to release at a point near equilibrium wherein said hammer is restrained in said position prior to the firing of said weapon, relatively independent of any associated mechanism and solely due to said position defining a condition of marginal stability and selective actuator means coupled to said hammer to impart a force thereto when selected in a direction to cause said hammer to revert from said condition of marginal stability to cause said hammer to strike said projectile when said actuator means are selected.

DETAILED DESCRIPTION OF FIGURES

Before proceeding with a detailed description, it is noted that while the invention has particular utility in providing reduced pressure actuated trigger mechanisms for automatic and semi-automatic weapons, the concepts and structure have utility in single shot and other weapons, as well.

Figure 1:
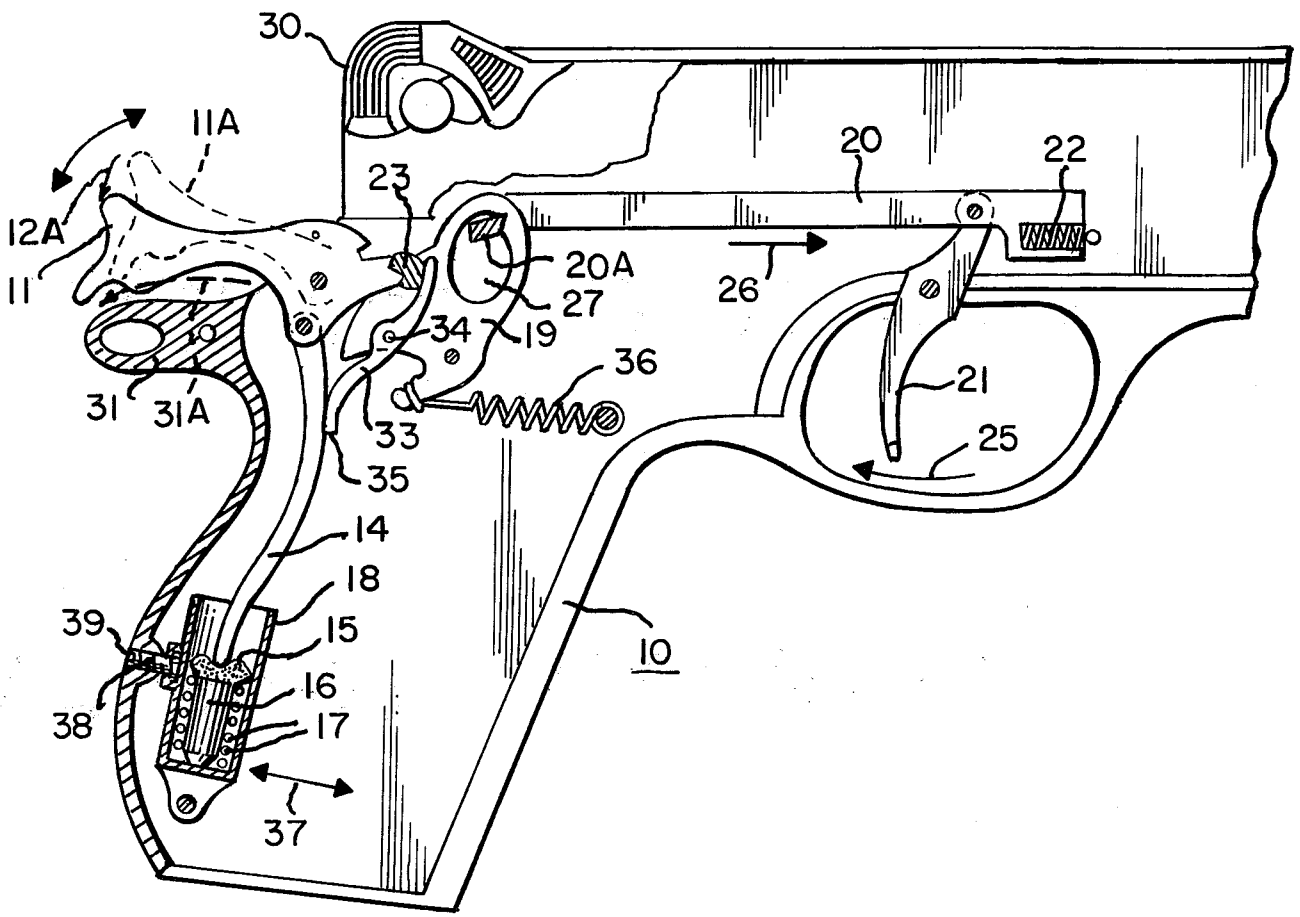
FIG. 1 is a partial structural side view of a trigger actuator mechanism according to this invention.

Referring to FIG. 1, there is shown a partial view of the trigger mechanism of a weapon as a pistol, which may be of the semi-automatic type. As such, many weapons operate accordingly and are designated as semi-automatic and so on. An example of such a weapon may be had by reference to U.S. Pat. No. 3,866,516 by David M. Frisoli, the applicant herein and issued on Feb. 18, 1975 entitled SEMI-AUTOMATIC PISTOL EMPLOYING A PIVOTALLY, SLIDEABLE MEMBER. This patent and U.S. Pat. No. 3,890,729 entitled PROJECTILE OR CARTRIDGE INJECTOR FOR AUTOMATIC WEAPONS EMPLOYING MAGAZINES issued on June 24, 1975 to said David Frisoli generally describe certain common operating characteristics of such automatic and semi-automatic weapons.

Referring to FIG. 1, there is shown a trigger mechanism according to this invention which may be included, for example, on a double action semi-automatic pistol 10. As indicated above, such pistols may be of many variations and many calibers, as the principles involved and the structure contemplated by this invention can be implemented in a great number of various firearms. For purposes of explanation, the pistol 10 is a semi-automatic pistol and hence, as indicated above, would not accommodate a hair trigger due to the automatic operation of the pistol during firing and recoil.

A typical hammer mechanism 11 is shown. The hammer has a relatively pointed extension 12, which conventionally engages a firing pin to ignite a cartridge during firing. The hammer is shown in a cocked position therefore depicting the weapon 10 in a ready to fire state. This position of the hammer according to this invention, is extremely important as the hammer 11 is positioned close to the equilibrium point or slightly on the negative side of the equilibrium or null position of the hammer assembly. What is meant by this will become clear when describing the remaining structure.

In many weapons, the hammer 11 is conventionally coupled to a strut 14. The strut 14 may be of an arcuate configuration and is coupled to a hammer plunger mechanism 15. The hammer plunger mechanism includes a shaft 16 surrounded by a hammer spring 17; all of which are enclosed in a retaining housing 18. Thus, as shown for the position of the hammer 11, the spring 17 is compressed due to the force exerted on the same via the strut 14 as coupled to the hammer 11.

In a normal gun, the strut 14 and the spring retaining housing 18 are aligned with respect to the receiving end of a gun so that at full cock, the hammer is set at a positive side of equilibrium. This, therefore assures that the hammer will fly forward when the trigger mechanism is accessed, as will be explained.

Also shown is a sear mechanism 19. The sear 19 is coupled to a crossbar 20 which in turn is coupled to a trigger mechanism 21. A trigger return spring 22 is shown for returning the trigger to a quiescent condition after it has been released by a user.

As can be seen from the figure, there is a dashed line representation of a hammer designated as 11A, which would be the location of a prior art hammer. To simplify matters, the operation of a conventional trigger is as follows:

When the prior art hammer as 11A is cocked, the strut 14 compresses the hammer spring 17 and the hammer is thus restrained in the position shown by the sear 19. The sear 19 may include a notch 23 located thereon which sits in a notch on the hammer to assure that the hammer will not move forward until the trigger 21 is activated. As can be seen from the Figure, as the trigger 21 is pressed or squeezed in the direction of the arrow 25, the crossbar 20 is pulled in the direction of arrow 26. The crossbar has a projecting end 20A which coacts with an aperture 27 located on the sear 19. Thus, the crossbar pulls the sear free from the hammer 11A. This allows the hammer, due to the force stored in the spring 17, to fly towards the firing pin located about area 30 and to therefore provide sufficient energy to drive the firing pin of the weapon causing it to ignite the cartridge in the chamber.

The reason that the prior art hammer 11A goes forward once the sear is released, is that it has been cocked at the positive side of a null position. The cocking of the hammer is assured by means of a stop 31 which is located beneath the hammer and prevents the hammer from going beyond a positive null position. A prior art stopping location is depicted by the dashed line 31A.

As one can ascertain from the Figure, if it were not for the stop 31, the hammer 11A can be pivoted beyond the null point. This would cause the strut 14 to lock the hammer so that it would not return at all upon release of the sear 19. This is undesirable in prior art guns, as a locked hammer would not release upon activation of the trigger 21.

Between the positive and negative positions is a central position of the hammer whereby it is at a point which can be referred to as a threshold of equilibrium. If the hammer were cocked at exactly this point, the plunger spring might cause it to go forward when the sear is released by the trigger or might cause it to lock. The condition is sometimes referred to as conditional or marginal stability.

In this invention, the hammer 11 is purposely cocked at this null point or equilibrium point or slightly negative to the same. This causes, as indicated above, the hammer to be in a marginally locked position whereby it might not move at all when the sear 19 is released by the trigger. This locking of the hammer 11 at the null is accomplished via the strut 14 and the spring 17. It is noted that if the hammer is, in fact, locked or at the null, there is absolutely no pressure or relatively little pressure exerted by the hammer 11 on the sear 19 and the sear therefore acts merely as a blocking mechanism to assure that the hammer will never spring forward, if the trigger is not activated.

Hence, the sear 19 acts as a blocking mechanism, rather than a release device as utilized in the prior art. Since in this position, there is no pressure on the sear, there is relatively little pressure on the trigger. Therefore, this invention contemplates the use, if desired, of a deeper notch in the hammer, thus assuring more intimate contact with the sear projection 23. The deeper notch will prevent the gun from firing if dropped and so on. Furthermore, the sear 19 does not have to be polished, nor treated as hardened due to the fact that there is relatively little pressure on the same.

Shown coupled to the sear 19 in this invention, is a crank 33 which will be freferred to as a hammer trip crank. The crank 33 in a double action gun is coupled to the sear 19 and may be pivotally mounted at a pivot point 34 on the frame of the gun. The stop 31 of the gun 10 is positioned such that the hammer is allowed to cock at the null point or slightly on the negative side of the null point.

In this invention, as the trigger is pulled, the projection 23 of sear 19 is removed from the hammer 11, as in prior art guns. However, as indicated, the hammer, being at null or slightly on the negative side of null, is locked. The crank 33, during trigger pull, is accessed by the notch 23, which pivots the crank so that the end 35 of the crank imparts a force to the strut 14. This slight force unbalances the hammer and is in a direction to cause the hammer to revert from a condition of marginal stability or revert from the negative side of the null point to the positive side and thus, the hammer 11A flies forward to strike the firing pin, as conventional.

It is important to note that the hammer 11 as cocked, is extremely unstable at the equilibrium point and may fly forward before the crank 33 ever touches the strut under certain conditions. However, this is not undesirable since the sear will block the hammer if the trigger is not activated. However, if the hammer is cocked on the negative side of equilibrium, the crank 33 assures that the strut is accessed to cause the hammer to fly forward. In this manner, since there is no pressure exerted by the hammer on the sear 19, the trigger pull can be practically determined by the force exerted by the sear return spring 36, which can be on the order of less than an ounce.

It is thus ascertained that the cocking of the hammer at equilibrium or slightly on the negative side of equilibrium virtually eliminates pressure on the sear, permitting activation of the hammer by negligible trigger pressure.

The function and concept depicted in FIG. 1 is illustrative only and it should be immediately apparent to those skilled in the art that there are a plurality of mechanisms not disclosed which can afford the necessary force to cause the hammer to revert from a condition of marginal stability to a positive firing action. Thus, any device which imparts a force to a hammer cocked as described is contemplated and is within the scope and bounds of this invention.

Figures 2, 3:
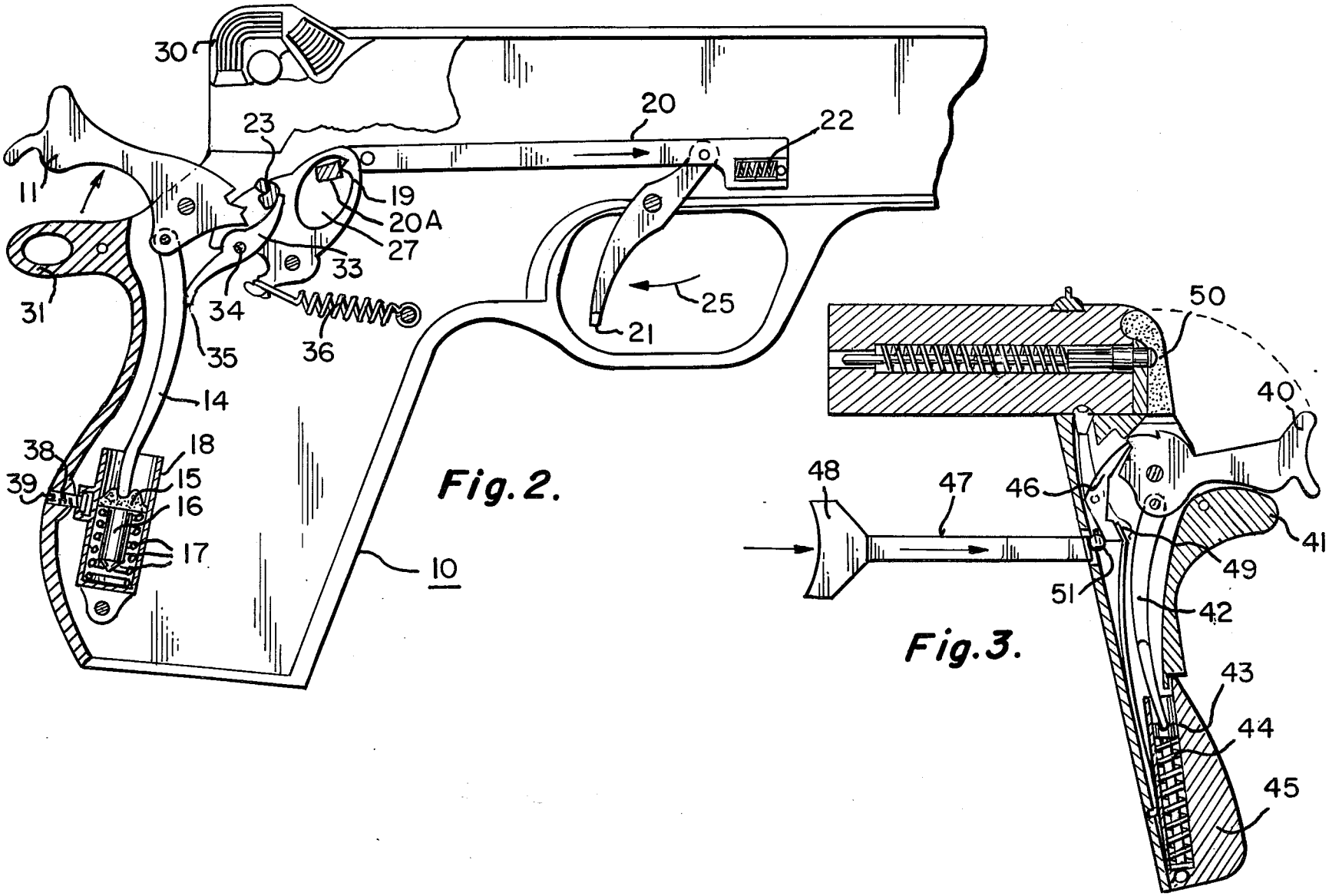
FIG. 2 is a view similar to FIG. 1 depicting the release action of a triggering mechanism according to this invention.
FIG. 3 is a structural side view of another embodiment of a triggering mechanism particularly useful for a single action weapon.

FIG. 2 is a schematic according to FIG. 1 showing the hammer trip crank 33 positively engaging the strut 14 during activation of the trigger 21.

It can be ascertained again from FIG. 2 of the positive action imparted by the mechanism to cause the hammer 11 to fly forward.

It is further noted that aside from the advantages depicted above and relating to the elimination of pressure from the sear 19 and the substantial reduction in trigger pull, that there are other advantages associated with the mechanism described. Thus, it should be apparent that due to the cocking of the hammer 11, the spring 17 is further compressed or more compressed then it is in prior art devices. Since the hammer spring 17 stores potential energy which is converted to kinetic energy by the hammer by further compressing the spring, one can impart greater velocity to the hammer; thus assuring reliable cartridge ignition.

Furthermore, the spring 17 is given more time to dissipate its energy and since there is a more efficient transfer of energy to the hammer, the operation of the mechanism results in a hair trigger mode for an automatic weapon, which eliminates all the disadvantages depicted above. The reliability is positively afforded by the fact that the sear 19 functions as a blocking mechanism, rather than a release mechanism, but still enables control of firing by the user, who must move the trigger to fire the weapon.

FIGS. 1 and 2 also disclose an adjustment mechanism 39 which may be included so the user can accurately adjust the null position of the hammer 14. The mechanism 39 includes a set screw 38 which has one end coupled to the retaining housing 18 to move the same in the direction shown by arrow 37 to therefore control or adjust the equilibrium point or setting point for the hammer 11 and the strut 14 mechanism.

Referring to FIG. 3, there is shown a triggering mechanism according to this invention as implemented on a single action type semi-automatic pistol.

A hammer 40 is shown cocked at null or slightly negative to a null point as ascertained by a stop 41. The hammer 40 is coupled to a strut 42 which again has one end accessing a hammer plunger 43 to compress a hammer spring 44 located in a hammer spring guide 45.

In the above configuration, the hammer is also cocked at the null point or at equilibrium and is conventionally restrained by a disconnector 46, which is activated by a crossbar 47 coupled to a trigger mechanism 48. The sear 49 is formed so that it has a projected end closest to the hammer strut 42. When the trigger 48 is pulled back, the crossbar pushes a disconnector pin 49, which in turn rotates the sear causing the projected end to eventually coact with the strut to force the hammer past the null point towards the positive side. The hammer thus strikes the firing pin 50 with increased velocity due to the increased compression of the spring 44 because of the full locked position of the hammer.

From the above figures and description, it could be ascertained that there are many ways of accomplishing this setting of the hammer at equilibrium or at a null position and then to impart a force to the hammer or strut to assure that the hammer will coact with the firing pin only upon activation of the trigger and as such, one can envision embodiments which might impart the force directly to the hammer in an opposite direction to that shown, or, for example, towards the firing pin. In a manually operated weapon, a trip crank or equivalent structure can be coupled directly to the trigger.

As indicated above, it is a main desire of this invention to operate the hammer with any type of weapon at the point of equilibrium or slightly negative to that point and then to impart a slight force directly to the hammer or associated assembly to insure the positive forward movement of the hammer under control of the triggering mechanism. In this manner, the apparatus and structure can be employed on a great plurality of weapons and has, as indicated, particular utility in regard to automatic and semi-automatic fire arms.

It is also noted that the manner in which the hammer is physically cocked, whether accomplished by the movement of a barrel or other mechanism in a semi-automatic or automatic weapon or by a manual operation, is not pertinent to the operating characteristics of this invention, as long as the hammer as cocked is caused to assume a rest position prior to firing at the null or equilibrium point or slightly negative thereto. Hence, conventional means employed in existing weapons of either automatically or manually cocking a hammer are envisioned as being with the teachings of this invention.

Many modifications and alternate embodiments should be apparent to those skilled in the art and all such structure is deemed to be encompassed within the scope and breadth of the claims appended hereto.

What is claimed is:

1. In a weapon of the type including a hammer means for striking a projectile, a sear for releasing said hammer when said weapon is to be fired, a trigger mechanism coupled to said sear and operative to remove the same from said hammer when said trigger is operated, in combination therewith the improvement comprising apparatus for substantially reducing the force necessary to operate said trigger, comprising:

a. first means for cocking said hammer means prior to firing of said weapon relatively at a null point for restraining said hammer means at said null point to cause said hammer means to self-lock relatively independent of said position of said sear, whereby said hammer means define a state of marginal stability, b. second means coupled to said sear and responsive to said trigger when operative to impart a force to said hammer means in a direction to alter said state of marginal stability to cause said hammer to strike said projectile when said trigger is operated, said second means including a pivotally mounted crank assembly having one end in proximity with said hammer, said crank assembly pivotally mounted on said sear to cause said crank assembly to impart a force to said hammer sufficient to alter said state of marginal stability when said sear is operated by said trigger.

2. In a semi-automatic weapon of the type including a hammer assembly for striking a firing pin when released from a cocked position by actuating a trigger mechanism coupled to a sear mechanism for exerting a restraining force to oppose the motion of said hammer until trigger activation, said hammer coupled to a strut operative to compress a spring when said hammer is cocked to provide energy to said hammer for striking said firing pin, the combination therewith, comprising:

a. first means for cocking said hammer relatively about a null point to compress said spring via said strut to cause said hammer to lock via said spring and strut at a position determinative of marginal stability, whereby said sear has relatively little force exerted thereon due to said locking of said hammer, and b. second means coupled to said sear and operative to impart a force on said hammer sufficient to release the same from said condition of marginal stability to cause said hammer to strike said firing pin, said second means including a crank member pivotally mounted on said sear and having one end coacting with said strut to impart a force to said strut and hence, to said hammer to release the same from said condition of marginal stability.

3. In a weapon of the type employing a hammer for striking a projectile to be fired when struck, the improvement in combination therewith of apparatus for providing a hammer release, comprising:

a. means coupled to said hammer for positioning the same prior to release at a point near equilibrium wherein said hammer is restrained in said position prior to the firing of said weapon, relatively independent of any associated mechanism and solely due to said position as defining a condition of marginal stability, b. a moveable blocking means located in front of said locked hammer to prevent movement of the same towards said firing pin in a first position and moveable in a second position to provide a free path for said hammer, c. selectable means coupled to said blocking means for moving the same to said second position, and d. means coupled between said blocking means and said hammer for imparting a force to said hammer during movement of said blocking means to said second position to cause said hammer to revert from said condition of marginal stability to thereby strike said projectile, said means including a crank lever pivotally mounted on said blocking means and having one end adapted to coact with said hammer, said lever operative to activate said hammer when said blocking means moves to said second position.

4. The hammer release according to claim 3 further including means mounted on said weapon and adapted when adjusted to selectively vary the locking position of said hammer about said null point.

5. The apparatus according to claim 3 wherein said weapon is a semi-automatic pistol.

6. The apparatus according to claim 3 wherein said selectable means includes a trigger mechanism.

* * * * *